US005930932A

United States Patent [19]

Peterson

[11] Patent Number: 5,930,932

[45] Date of Patent: Aug. 3, 1999

[54] SHOOTING REST

[76] Inventor: Thomas K. M. Peterson, 124 Stoney Point Rd., Courtland, Minn. 56021

[21] Appl. No.: 08/997,466

[22] Filed: Dec. 23, 1997

[51] Int. Cl.[6] ..... F41A 27/30

[52] U.S. Cl. ..... 42/94

[58] Field of Search ..... 42/94; 248/166; 135/127

[56] References Cited

U.S. PATENT DOCUMENTS

| | | | |
|---|---|---|---|
| 4,934,638 | 6/1990 | Davis | 248/164 |
| 4,979,531 | 12/1990 | Toor et al. | 135/104 |
| 5,311,693 | 5/1994 | Underwood | 42/94 |
| 5,317,826 | 6/1994 | Underwood | 42/94 |
| 5,377,437 | 1/1995 | Underwood | 42/94 |
| 5,406,732 | 4/1995 | Peterson | 42/94 |
| 5,507,111 | 4/1996 | Stinson et al. | 42/94 |

*Primary Examiner*—Charles T. Jordan
*Assistant Examiner*—Denise J. Buckley
*Attorney, Agent, or Firm*—Roger W. Jensen

[57] ABSTRACT

A shooting rest comprising a pair of elongated rods having a preselected cross section and a multi-function clamp means comprising a special elastic yoke for receiving the rods and holding the rods with the longitudinal axes thereof in a plurality of preselected angular relationships. The yoke means further permits the holding of the rods at a plurality of preselected locations along the longitudinal axes of the rods.

14 Claims, 2 Drawing Sheets

FIG. 3
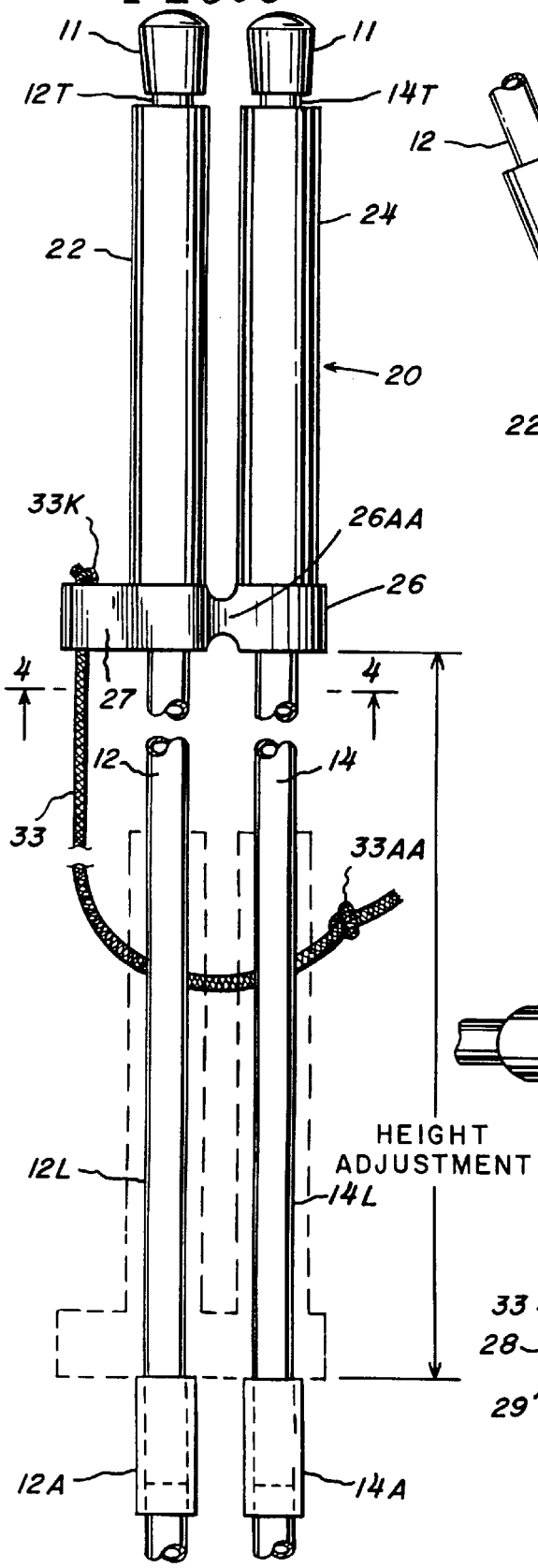
FIG. 6
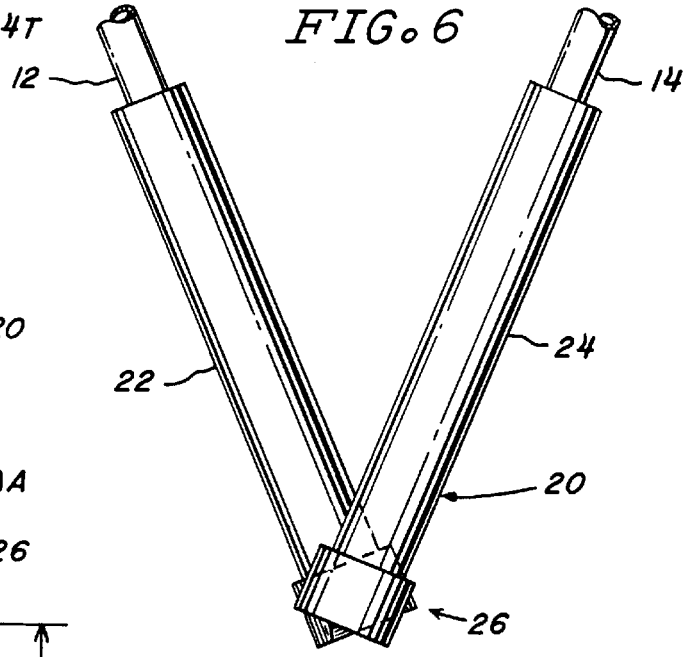
FIG. 5
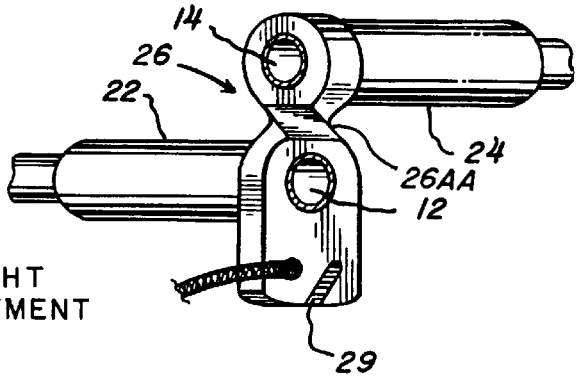
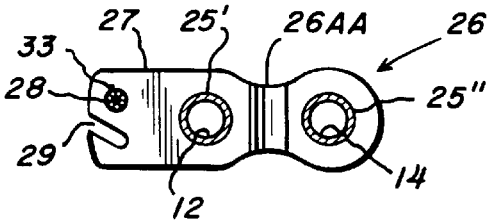
FIG. 4

SHOOTING REST

FIELD AND BACKGROUND OF THE INVENTION

This invention relates to portable rests for shooters to rest their long barreled firearms such as rifles and shotguns, or handguns such as pistols and revolvers so as to facilitate long range accuracy in the shooting of the guns.

There are, of course, a number of prior art shooting rests for marksmen. It is understood that Native Americans used a pair of crossed arrows as a support for their long barreled buffalo rifles in the latter 19th century. Since that time there have been a significant number of shooting rest monopods, bipods and tripods developed which are known by those skilled in the art. My prior U.S. Pat. No. 5,406,732 showing a bipod is an example of the prior art arrangements.

My present invention has several significant advantages over my prior U.S. Pat. No. 5,406,732 and all other prior art shooting rests. In particular, my present invention permits a more convenient, rapid and noiseless setup to enable the shooter to begin sighting and shooting in the shortest possible time. My invention comprises, in part, a molded rubber flexible yoke or coupling which holds a pair of rods or foldable legs. In the preferred embodiment the legs fold to about 14 inches in length for compact transport in a belt sheath or for storage in a backpack. When folded, the legs are substantially parallel within the elastic yoke. When needed, the legs are released and quickly unfold and automatically assemble to about 39 inches, utilizing an internal shock cord and ferules. The legs can be crossed to any desired angle, this being permitted by flexing of the yoke. The molded rubber yoke protects stock finish and permits firearms to cant, tilt or pan up to 60 degrees in any direction, permitting hunters to get "on-target" quickly and to track moving game.

The flexible yoke coupling allows fast height adjustments by simply altering the angle to the crossed rods or legs. Also, the yoke may be slip adjusted along the longitudinal axis of the legs to suit the shooter's height. When the yoke is at rest, the above mentioned slip adjustment is permitted as the yoke then may be freely moved along the legs. However, when the legs are crossed, then the flexible yoke binds and thus fixedly clamps the legs to prevent any relative longitudinal movement of the legs with respect to the yoke.

SUMMARY OF THE INVENTION

My invention provides a shooting rest comprising a pair of elongated rods each having an upper end, a lower end, a longitudinal axis and a preselected cross section, the preselected cross section in the preferred embodiment being circular. A key point of novelty in my invention is a multi-function holder means for receiving the rods and resiliently or flexibly holding the rods with the longitudinal axes thereof in a plurality of preselected angular crossing positions and at a plurality of preselected longitudinal locations along the longitudinal axes of the rods. More specifically, the holder means consist of a molded rubber flexible yoke member having a pair of parallel disposed, spaced apart, elongated tubular elements each having a longitudinal axis and an internal cross section preselected to freely receive one of the rods. The yoke member further includes a twistable flexible segment connecting, at one end thereof, the pair of tubular elements. The pair of rods are assembled with the flexible yoke member by having the upper ends of the rods inserted respectively into the pair of tubular elements. The rods are adjusted longitudinally within the tubular elements of the yoke to a preselected position. Then one of the rods is rotated relative to the other about an axis perpendicular to the aforesaid longitudinal axes and further defined by the twistable flexible segment of the yoke to a preselected position. The twistable flexible segment of the yoke has several functions: first to flexibly and elastically connect the tubular elements together as aforesaid and second, when twisted, to create stresses with the yoke's mass to cause an increased impingement on the rods, i.e., to cause an additional gripping force on the rods to prevent slippage after height adjustments are made. Thus the twisted flexible segment grips said rods from moving longitudinally with respect to said hollow elements.

Thus the duplex function flexible yoke member provides a unique means for holding the rods with the longitudinal axes thereof in a plurality of preselected angular relationships and at a plurality of preselected locations along the longitudinal axes of the rods.

BRIEF DESCRIPTION OF THE DRAWINGS

FIG. 3 is a side elevational view of the upper ends of the rods inserted into the molded rubber flexible yoke member 20;

FIG. 4 is a view of the apparatus shown in FIG. 3 as viewed along section lines 4—4 thereof;

FIG. 5 is a bottom view of the yoke with assembled rods 12 and 14 and with the tubular yoke elements 22 and 24 being rotated, one with respect to the other, the rotation being facilitated by the twistable flexible segment 26 of the yoke;

FIG. 6 is a side elevational view of the yoke as depicted in FIG. 5.

DETAILED DESCRIPTION OF THE PREFERRED EMBODIMENT

Figure 1:
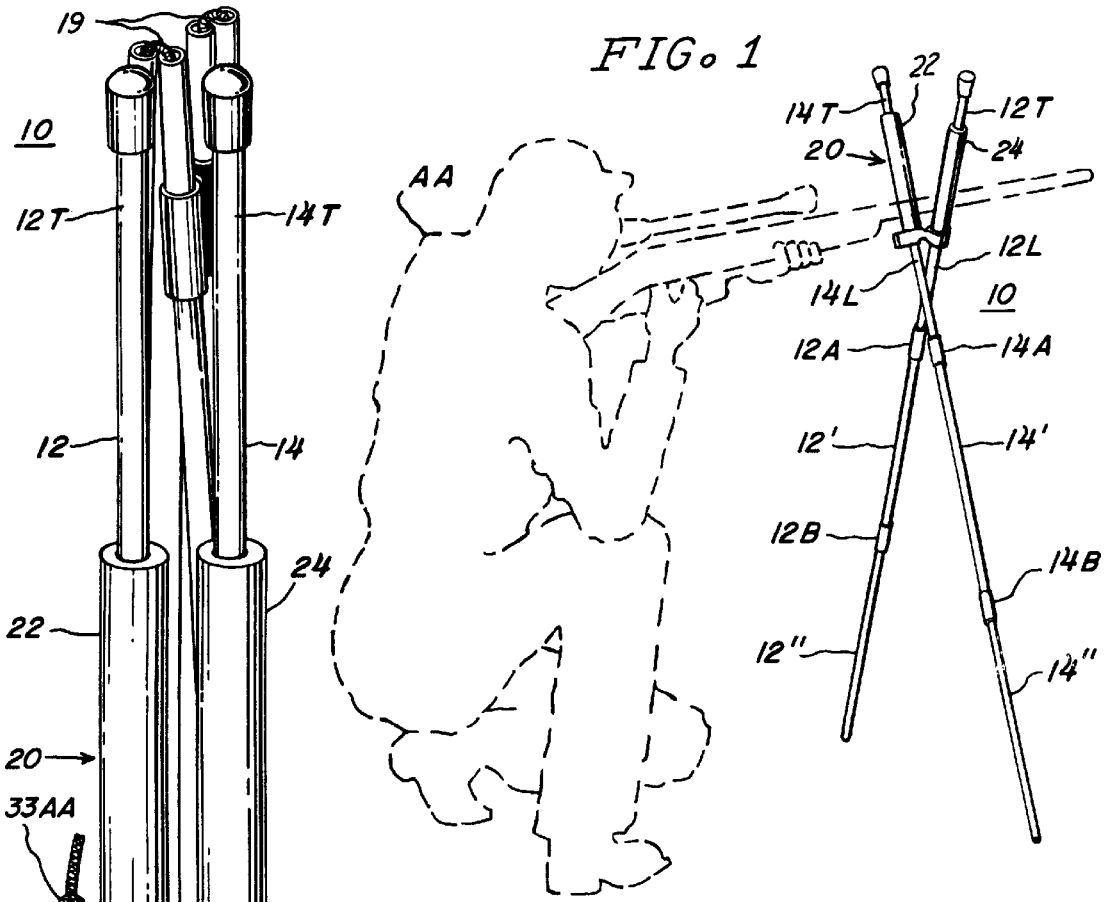
FIG. 1 is a perspective view of a preferred embodiment of my shooting rest showing, in phantom, a kneeling shooter using the rest to steady a rifle.

Referring to FIG. 1, a shooter AA is shown in phantom using the shooting rest to support a rifle barrel, the shooting rest being generally designated by reference numeral 10 and comprising a pair of elongated hollow rods 12 and 14 each having upper or top ends 12T and 14T and lower ends 12L and 14L respectively. The rods have a preselected external cross section which in the preferred embodiment is circular although the scope of this invention would include other cross sections such as square, oval, triangular, hexagon or other preselected cross sections. The hollow rods are preferably made of light weight metallic material such as aluminum but it will be understood that other materials such as fiberglass or plastic could be substituted.

In the preferred embodiment both rods 12 and 14 have two additional hollow segments 12', 12" and 14', 14" respectively. Thus, for example, rod 12 would have segments 12' and 12" as extensions, the three elements being interconnected with an internal elastic shock cord 19 (see FIG. 2). Ferule means 12A, 12B and 14A, 14B for rods 12 and 14 respectively provide couplings to maintain the three assembled segments rigid when fully unfolded as is shown in FIG. 1.

At the extreme upper ends of the rods 12 and 14 may be placed suitable end caps 11 and at the bottom end of segments 12" and 14" may be placed caps or points (not shown) for facilitating good contact with the ground.

A multi-function clamp means or flexible molded rubber yoke means is generally designated by reference numeral 20 and has several functions. First, the yoke receives the upper ends of rods 12 and 14 and resiliently holds the rods with their longitudinal axis in a plurality of preselected angular crossing positions. Second, the yoke permits its positioning at a plurality of preselected longitudinal locations along the longitudinal axes of the rods.

Another function of the yoke is to provide a "soft" surface for supporting the gun stock or barrel thus protecting same from marring.

The yoke 20 in the preferred embodiment is thermoplastic rubber, utilizing "Santoprene" sold by Advanced Elastomer Systems. The hardness is 73 on the Shore "A" hardness scale and the material has the desired characteristics at temperatures from below zero degrees Fahrenheit to over 100 degrees Fahrenheit.

Figure 2:
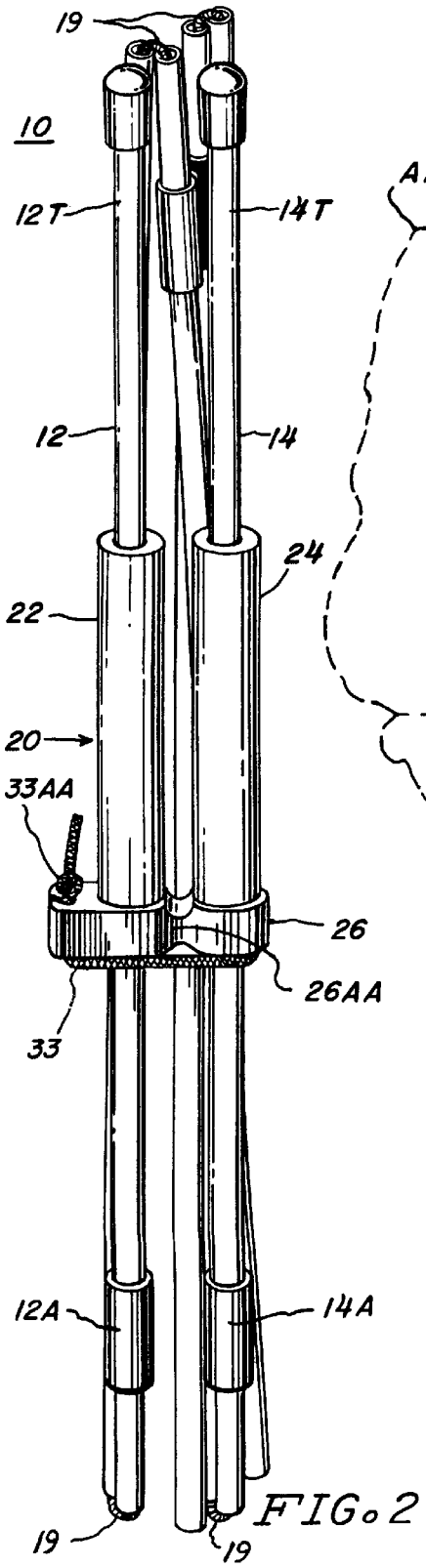
FIG. 2 is an elevational view of my shooting rest when folded up and secured for storage or transport.

The yoke means 20 is shown in its "at rest" position in FIG. 2; it comprises a pair of parallel disposed spaced apart elongated tubular elements 22 and 24 which are shown in FIG. 2 to be assembled on the upper ends 12T and 14T of the rods 12 and 14. Thus each of the tubular elements 22 and 24 has a longitudinal axis and an internal cross section preselected to freely receive one of the rods 12 and 14. The flexible yoke member 20 further includes a twistable bight or base portion 26 connecting, as shown in FIG. 2, the bottom ends of elements 22 and 24. The portion of base member 26 intermediate the tubular elements 22 and 24 is identified by reference numeral 26AA (see FIGS. 2, 4 and 5). At one end of base member 26, as is best shown in FIG. 4, is an extension 27 having at the extremity thereof a bore 28 and a slot 29 which are used together with a cord 35 for securing the shooting rest when it is folded up for transport or storage.

FIG. 3 shows how the yoke member 20 may be moved along the longitudinal axes of the rods 12 and 14. More specifically in FIG. 3 the solid depiction of yoke 20 shows that the yoke is positioned at or near the extreme upper end of rods 12 and 14 while the lower or bottom portion of FIG. 3 shows the yolk in dotted configuration. Thus there is a height adjustment available which translates into a choice by the shooter as to how high off the ground he wants the cross legs to be for resting his gun.

Referring again to FIG. 4, it will be seen that the base portion 26 of the yoke shows in this view the ends 25' and 25" of the elongated tubular elements 22 and 24; also shown in FIG. 4 are the rods 12 and 14 which are received by the bores 25' and 25" respectively. As indicated above in the preferred embodiment, the bores 25' and 25" as well as the preselected cross section of the rods 12 and 14 are circular but, if desired, other cross sections could be utilized just so long as the tubular elements 22 and 24 can receive the ends of the rods. In FIG. 4 no gap is shown between the rods 12 and 14 and the bores 25' and 25" as the flexible nature of the yoke provides a slight yet positive friction fit of the rods within the tubular elements 22 and 24 as long as the yoke 20 is at rest. The positive friction fit, as aforesaid, is slight so as to permit the shooter to adjust the height of the crossing point by sliding the rods longitudinally within the tubular elements 22 and 24.

FIG. 5 shows a view of the yoke when base or bight portion 26AA is twisted, as is also shown in FIG. 6. The twisting of the bight portion 26AA would have the effect (in the absence of the rods 12 and 14) of distorting the openings 25' and 25" from a circular shape, as shown in FIG. 4, to a noncircular form. However when the rods 12 and 14 are in the tubular elements 22 and 24 and the bight portion 26AA is twisted, the twisting action creates stresses within the bight portion to significantly increase the frictional force from the "at rest" slight positive friction fit to a point whereat the rods 12 and 14 are firmly gripped by the yoke elements 22 and 24 respectively. This is an important feature of my invention because when the rods are rotated to form the shooting rest, then the aforementioned stresses adjacent openings 25' and 25" serves to firmly grip and hold the rods against relative longitudinal motion with respect to the yoke.

Referring again to FIGS. 2, 3 and 4, an elastic cord 33 passes through the bore 28. One end of the cord has a knot or the like 33K thus securing the cord to the extension 27 of base portion 26 of the yoke. The cord 33 has another end shown in FIG. 3 as having another knot 33AA which, when the shooting rest is folded up and held together, is positioned in slot 29 (see FIGS. 4 and 2).

Figure 7:
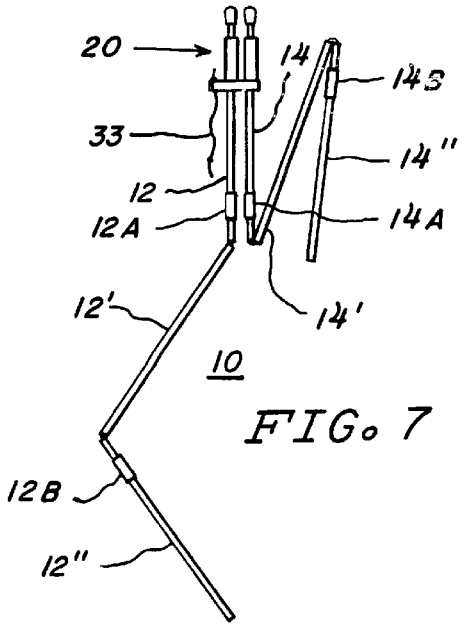
FIG. 7 is a showing of the shooting rest as the legs are unfolding.

FIGS. 7 shows the shooting rest as the legs are automatically unfolding after cord 33 has been released.

Thus, in summary, the yoke 20 not only functions to provide an adjustable height shooting rest and means for locking same to the rods when twisted, but also provides a relatively soft supporting surface for the barrel or stock of the gun, this arrangement precluding or minimizing any scratching or marring of the surface of the gun. The yoke further provides a means to secure the folded legs in a compact, transportable bundle. The stock/barrel protection feature moves automatically with the adjustable cross-point. This saves time when compared to prior art arrangements where the stock guards had to be separately moved. It is important to have the stock/barrel guards to prevent damage to firearm finishes, especially under recoil from the firearm.

It will be further understood that the cross-point height above the ground plane can be adjusted in two ways. The first is discussed above, i.e., by moving the rods 12 and 14 within the yoke. Secondary height adjustments can be quickly made by merely changing the crossing angle of legs 12 and 14.

The embodiments of an invention in which an exclusive property or right is claimed are defined as follows:

1. A shooting rest for rifle, shotgun and handgun shooters comprising:

a) a pair of elongated rods each having an upper end, a lower end, a longitudinal axis and a preselected cross section; and b) a multi-function yoke means of rubber like material for receiving said rods and resiliently holding said rods with said longitudinal axes thereof in a plurality of preselected angular crossing positions and at a plurality of preselected longitudinal locations along said longitudinal axes of said rods, said yoke means including a bight portion and a pair of spaced apart elongated tubular elements connected to said bight portion and depending therefrom in adjacent, parallel relationship, each of said elements having a longitudinal axis and an internal cross section preselected to receive one of said rods, said bight portion having a twistable elastic segment whereby said rest may be assembled to provide an adjustable height shooting support by the insertion of said rods, respectively, into said pair of tubular elements, adjusting said rods longitudinally within said tubular elements to a preselected position, and then rotating said rods relative to each other about an axis defined by said twistable elastic segment to a preselected position of said longitudinal axes of said rods, said twistable segment having two functions: first to elastically connect said tubular elements as aforesaid, and second, to create stresses within said elastic segment when twisted, to thereby hold said rods from moving longitudinally with respect to said elements, said elongated tubular elements being further characterized by having a longitudinal extend substantially greater than said internal cross-section so as to provide a longitudinally extending and soft surface for receiving a gunstock.

2. Apparatus of claim 1 further characterized by each of said rods comprising at least two separate elongated segments.

3. Apparatus of claim 2 further characterized by said rod segments being interconnected by an elastic shock cord.

4. Apparatus of claim 1 further characterized by including a cord having two ends, one end thereof being fixed to said yoke member and the other end thereof being adapted, when said rods are bundled, to be selectively wrapped around said bundled rods and attached to and detached from said yoke member to facilitate storage and transport of said bundled rods.

5. Apparatus of claim 1 further characterized by said rods being hollow with a circular cross section.

6. An improved shooting rest for rifle, shotgun and handgun shooters comprising in part a pair of elongated rods each having an upper end, a lower end, a longitudinal axis and a preselected cross section; the improvement comprising a multi-function yoke means of rubber-like material for receiving said rods and resiliently holding said rods with said longitudinal axes thereof in a plurality of preselected angular crossing positions and at a plurality of preselected longitudinal locations along said longitudinal axes of said rods, said yoke means including a bight portion and a pair of spaced-apart elongated tubular elements connected to said bight portion and depending therefrom in adjacent, substantially parallel relationship, each of said elements having a longitudinal axis and an internal cross section preselected to receive one of said rods, said bight portion having a twistable elastic segment whereby said rest may be assembled to provide an adjustable height shooting support by the insertion of said rods, respectively, into said pair of tubular elements, adjusting said rods longitudinally within said tubular elements to a preselected position, and then rotating said rods relative to each other about an axis defined by said twistable elastic segment to a preselected position of said longitudinal axes of said rods, said twistable elastic segment having two functions: first to elastically connect said tubular elements as aforesaid, and second, to create stresses within said segment, when twisted, to thereby hold said rods from moving longitudinally with respect to said elements, said elongated tubular elements being further characterized by having a longitudinal extent substantially greater than said internal cross-section so as to provide a longitudinally extending and soft surface for receiving a gunstock.

7. Apparatus of claim 6 further characterized by each of said rods comprising at least two separate elongated segments.

8. Apparatus of claim 7 further characterized by said rod segments being interconnected by an elastic shock cord.

9. Apparatus of claim 6 further characterized by including a cord having two ends, one end thereof being attached to said yoke member and the other end thereof being adapted to be selectively attached to and detached from said yoke member.

10. Apparatus of claim 6 further characterized by said tubular elements having a circular cross section.

11. Apparatus of claim 1 further characterized by said tubular elements of said yoke providing padded, non-marking surfaces for receiving a firearm.

12. Apparatus of claim 6 further characterized by said tubular elements of said yoke providing padded, non-marking surfaces for receiving a firearm.

13. Apparatus of claim 1 further characterized by said tubular elements engaging said rods (i) with a slight positive friction fit when said yoke is at rest, and (ii) with a strong positive frictional fit when the rods are rotated relative to each other about an axis defined by said twistable elastic segment to thereby hold said rods from moving longitudinally with respect to said elements.

14. Apparatus of claim 6 further characterized by said tubular elements engaging said rods (i) with a slight positive friction fit when said yoke is at rest, and (ii) with a strong positive frictional fit when the rods are rotated relative to each other about an axis defined by said twistable elastic segment to thereby hold said rods from moving longitudinally with respect to said elements.

* * * * *